US008272378B2

(12) United States Patent
Tutsch et al.

(10) Patent No.: US 8,272,378 B2
(45) Date of Patent: Sep. 25, 2012

(54) SYSTEM AND METHOD FOR IMPROVING ENDURANCE OF INSPIRATORY MUSCLES

(75) Inventors: Christian Tutsch, Gablitz (AT); Friedrich Netauschek, Höflein (AT)

(73) Assignee: Eumedics Medlzintechnik und Marketing GmbH, Purkersdorf (AT)

( * ) Notice: Subject to any disclaimer, the term of this patent is extended or adjusted under 35 U.S.C. 154(b) by 584 days.

(21) Appl. No.: 12/104,194

(22) Filed: Apr. 16, 2008

(65) Prior Publication Data

US 2009/0264255 A1 Oct. 22, 2009

(51) Int. Cl.
*A61B 5/00* (2006.01)

(52) U.S. Cl. ..... 128/200.24; 600/538

(58) Field of Classification Search ..... 482/13; 600/538; 128/200.24
See application file for complete search history.

(56) References Cited

U.S. PATENT DOCUMENTS 3,961,627 A * 6/1976 Ernst et al. ..... 128/204.21
4,301,810 A 11/1981 Belman
4,533,137 A 8/1985 Sonne
4,770,413 A 9/1988 Green
4,981,295 A 1/1991 Belman et al.
6,165,105 A 12/2000 Boutellier et al.
6,554,746 B1 4/2003 McConnell et al.
7,625,345 B2 * 12/2009 Quinn ..... 600/538
2004/0063544 A1 * 4/2004 Lawson ..... 482/13
2007/0016093 A1 * 1/2007 Rapoport et al. ..... 600/533
2007/0089740 A1 4/2007 Baumert et al.

OTHER PUBLICATIONS

Biegler Medizinelektronik, RESPIFIT S—Respiratory Muscles Training Device, Instructions for Use, Edition Apr. 2007.

* cited by examiner

*Primary Examiner* — Jerome W Donnelly
(74) *Attorney, Agent, or Firm* — Greer, Burns & Crain, Ltd.

(57) ABSTRACT

Training the inspiratory muscles using a training device includes evaluating the endurance of the inspiratory muscles of the patient, including the time to the onset of exhaustion, setting parameters of the training device, directing an monitoring endurance training sessions using the training device, providing feedback to the patient during the training and repeating the testing, setting, directing and providing steps as periodically.

10 Claims, 14 Drawing Sheets

SYSTEM AND METHOD FOR IMPROVING ENDURANCE OF INSPIRATORY MUSCLES

FIELD OF THE INVENTION

This invention relates to a system and method for training respiratory muscles to improve muscle endurance. More specifically, it relates to use of a training device that performs evaluation of the endurance of the inspiratory muscles in a patient, sets parameters for an exercise regimen, then provides direction and feedback to the patient as exercises are executed.

BACKGROUND

Chest movement during breathing is controlled by the inspiratory and expiratory muscles, including the diaphragm and rib cage muscles. Respiratory muscle function is described in terms of muscle strength and muscle endurance. A number of diseases result in respiratory muscle dysfunction, including stroke, congestive heart failure, emphysema, chronic bronchitis, neuromuscular diseases and the like, reducing respiratory muscle strength and/or endurance. Advanced age can also lead to decreased function of the respiratory muscles. Like other muscles in the body, the inspiratory muscles can be trained for strength and endurance. For the purposes of this invention, strength exercises are those designed to have a large load for a short duration, while endurance exercises have a lighter load for a longer period of time.

Research has been devoted to measuring muscle strength and muscle endurance, as well as establishing normative values. Respiratory therapists are trained to test respiratory muscles. A number of hand-held spirometers are available to measure muscle strength. However, little has been done to rehabilitate muscles rendered dysfunctional as a result of disease. The health care industry does not seem to have realized the value of training these muscles in a manner similar to training of other muscles in the body.

In "Evaluation . . . ", herein incorporated by reference, values of inspiratory muscle strength and inspiratory muscle endurance were measured by flow-resistive loads for a group of 68 people for the purpose of establishing normative values. After the single test value was obtained, the researchers failed to take the steps necessary to try to improve the muscle function.

There are some devices on the market that can be used to exercise the inspiratory muscles. Many of these devices merely have the patient breathe against an inspirational load. No feedback is provided to the patient as to whether the exercise is being done correctly, or of there is improvement in the inspiratory muscle function. Few of these devices address endurance training at all.

There is, therefore, a need in the art for a system and method of testing and exercising the endurance of the inspiratory muscles. Data from the tests and exercises are used to set parameters for subsequent exercise sessions so that muscle endurance continues to develop.

SUMMARY OF THE INVENTION

These and other needs are met or exceeded by the system and method for improving the endurance of inspiratory muscles. More specifically, the training method for training the inspiratory muscles using a training device includes evaluating the endurance of the inspiratory muscles of the patient, including the time to the onset of exhaustion, setting parameters of the training device, directing and monitoring endurance training sessions using the training device, providing feedback to the patient during the training and repeating the testing, setting, directing and providing steps periodically.

The system and method of this invention allows a patient to improve the function of the inspiratory muscles at lower cost, increased comfort, convenience and privacy by practicing exercises at home or at his doctor's office. It is no longer necessary to go to an expensive therapist for each exercise session. Using the instant system and method, the patient can do the exercises at a convenient time at home. Yet, like a therapist, feedback is provided as to whether the patient is doing the exercises properly and progress made in improving the muscle strength and endurance.

When the training device includes the optional reader/writer for an electronic storage medium, the doctor, therapist or other health care professional receives the data from every exercise session so that they are informed of the patient's progress. Periodically, the patient repeats the evaluation and resets some parameters of the patient device. The most recent settings are recorded on the storage medium as well, so that the health care professional has records of the current and historical values of these settings. With this complete knowledge at hand, a complete picture of the patient's training and progress is available to the health care professional.

Further, the combination of both strength and endurance training is similar to weight training for other muscles of the body. Strength without endurance is a less effective means of rebuilding muscle tone than when both exercises are done together. Periodic reevaluation for both endurance and strength allows for continuing muscle development.

In addition to rehabilitation of a patient, the system and method for improving endurance can also be used by healthy individuals, or even athletes, to improve the endurance of inspiratory muscles. Athletes, for example, need to be able to provide oxygen to muscles over prolonged periods of exertion. It does little good, for example, to train the legs to run an endurance race when the athlete cannot breathe part way through the race. This method and system allows for specific endurance training of the inspiratory muscles to keep up with the other muscles.

DETAILED DESCRIPTION OF THE DRAWINGS

DETAILED DESCRIPTION OF THE INVENTION

Figure 1:
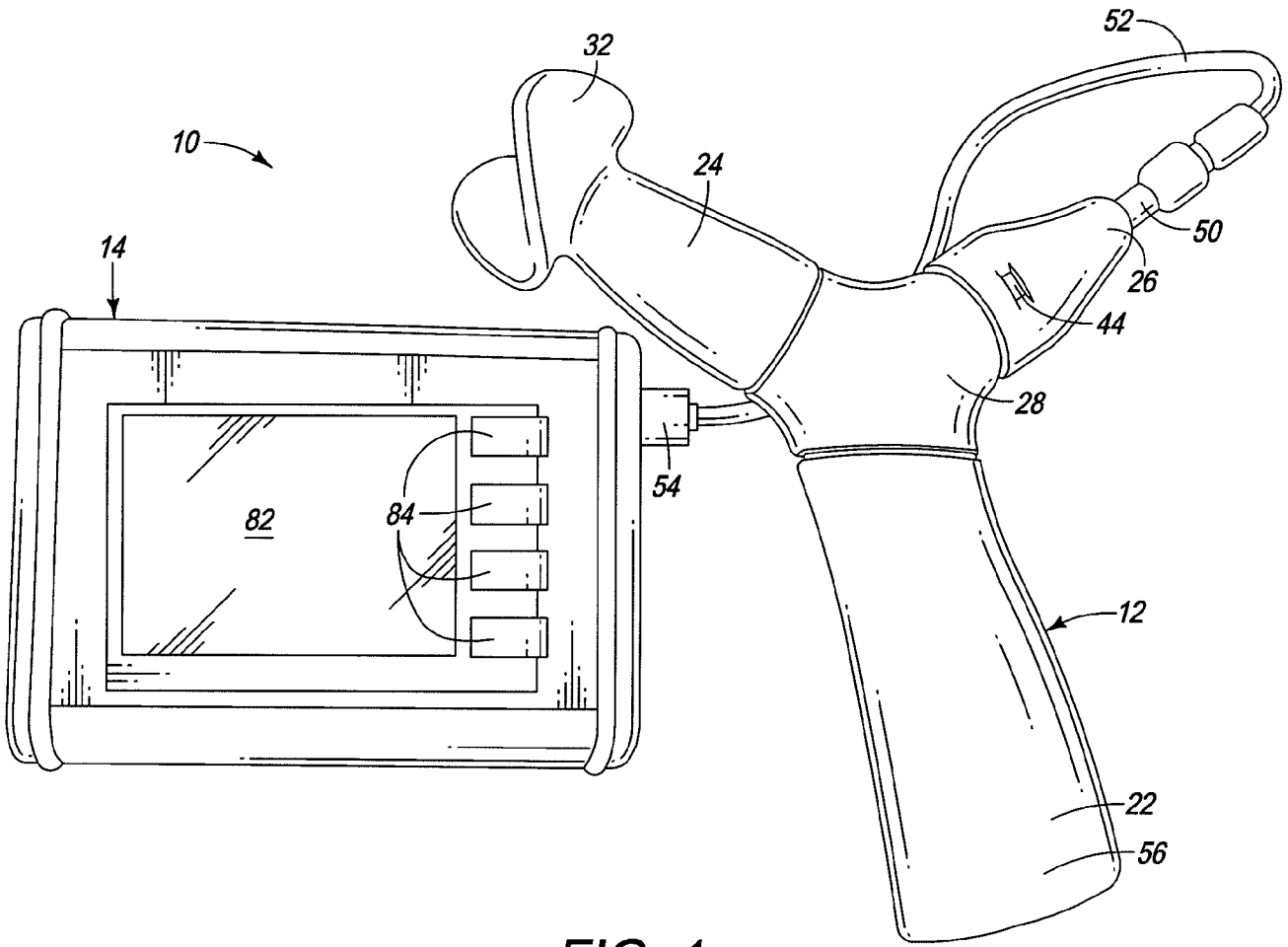
FIG. 1 is a front plan view of the training device of the present invention.

A method for improving the endurance of inspiratory muscles of a patient using a training device, generally 10, includes directing a patient to perform certain exercises. The exercises are to be done using a training device 10 having at least two components, a patient module, generally 12, and an electronic module, generally 14. The patient module 12, shown in FIG. 1, is a hand held device into which the patient breathes. The patient module 12 is in fluid communication with the training module 14, allowing measurement of the pressure generated by the respiratory pump and calculation of the resulting air flow. Software 16 loaded onto a microcontroller 20 within the electronic module 14 measures the pressure and calculates the rate of air movement during the exercises. The software 16 also provides feedback to the patient as to the success of the exercises both during and at the end of the exercise session.

As used herein, the term "patient" is used broadly to describe the person using the training device to improve the endurance of his/her inspiratory muscles. It is not intended to be limited to persons with medical problems. To the contrary, the system and method are also intended to be used by athletes and others in good health to improve their inspiratory muscle endurance.

The system and method of the present invention improves the endurance of inspiratory muscles of a patient by evaluating and training the inspiratory muscles. In the following discussion, elements of strength training are included in the description, but it is to be understood that the strength training steps are not required in the invention. The system comprises the training device 10 and software 16, whereby the software is programmed to evaluate the endurance and strength of the patient. Next, the software sets parameters so that the training develops the endurance and strength of the patient's inspiratory muscles. During training sessions, the training device provides feedback to the patient as to one or more of the time remaining in the exercise, the success of each exercise, the success of the training session, the number of exercises remaining in the training session and the like. Also, the training device 10 monitors the inspiratory pressure, converting it into a volume if necessary, and compares the current values with minimum and/or maximum values to be achieved during the exercises. Some of the parameters should be updated periodically by reevaluating the patient so that the exercises continue to work the inspiratory muscles at an appropriate level.

Figure 2:
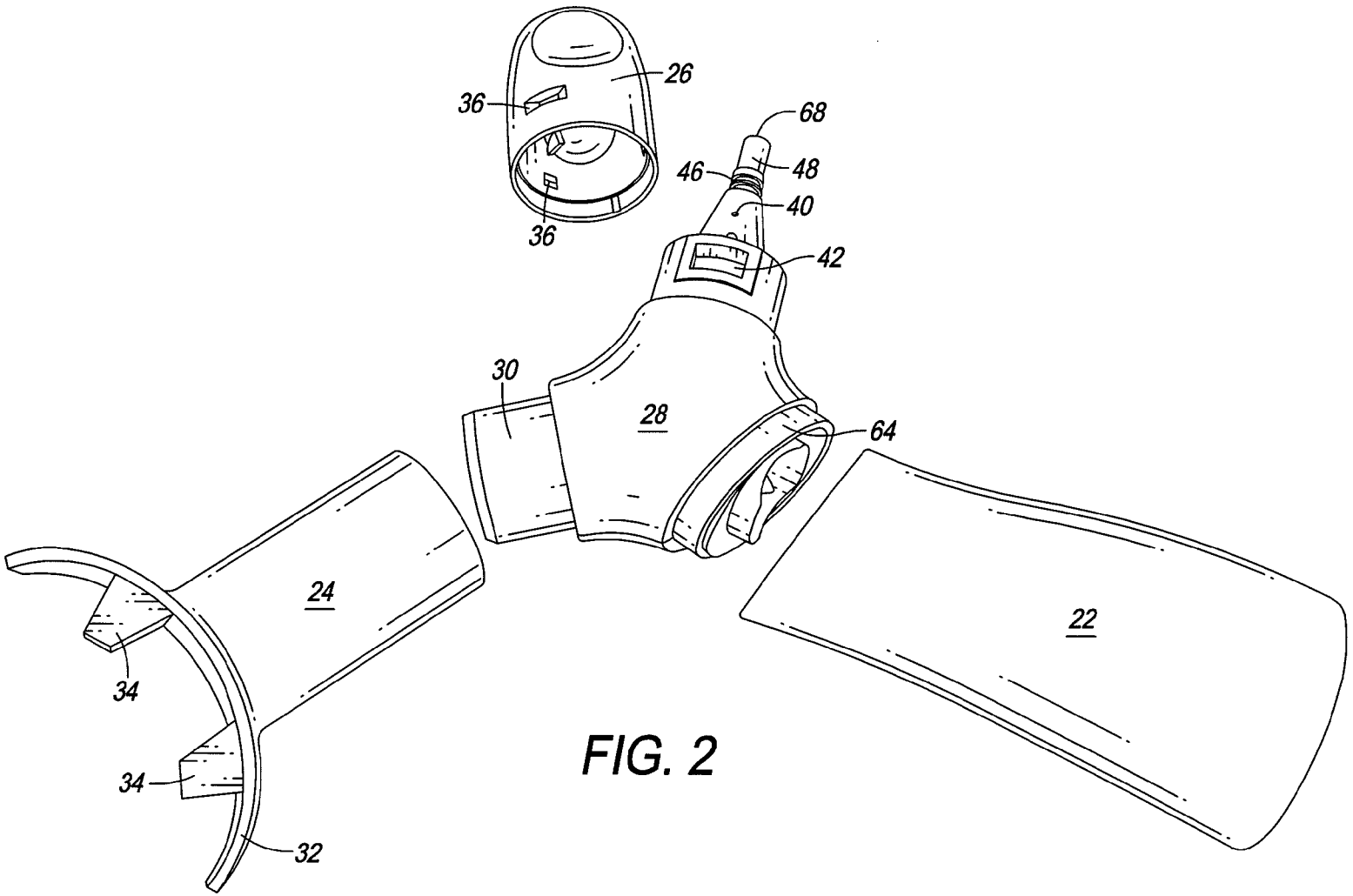
FIG. 2 is a exploded view of the patient module.

The patient module 12 is a specialized device designed for use with respiratory patients. Referring to FIGS. 1 and 2, the patient module 12 includes four elements: the handle 22, the mouthpiece 24, the selector 26 and the Y-piece 28. Each of the other three parts fits onto the Y-piece 28 for use, but can preferably be disassembled for cleaning or storage of the patient module 12.

Figure 3:
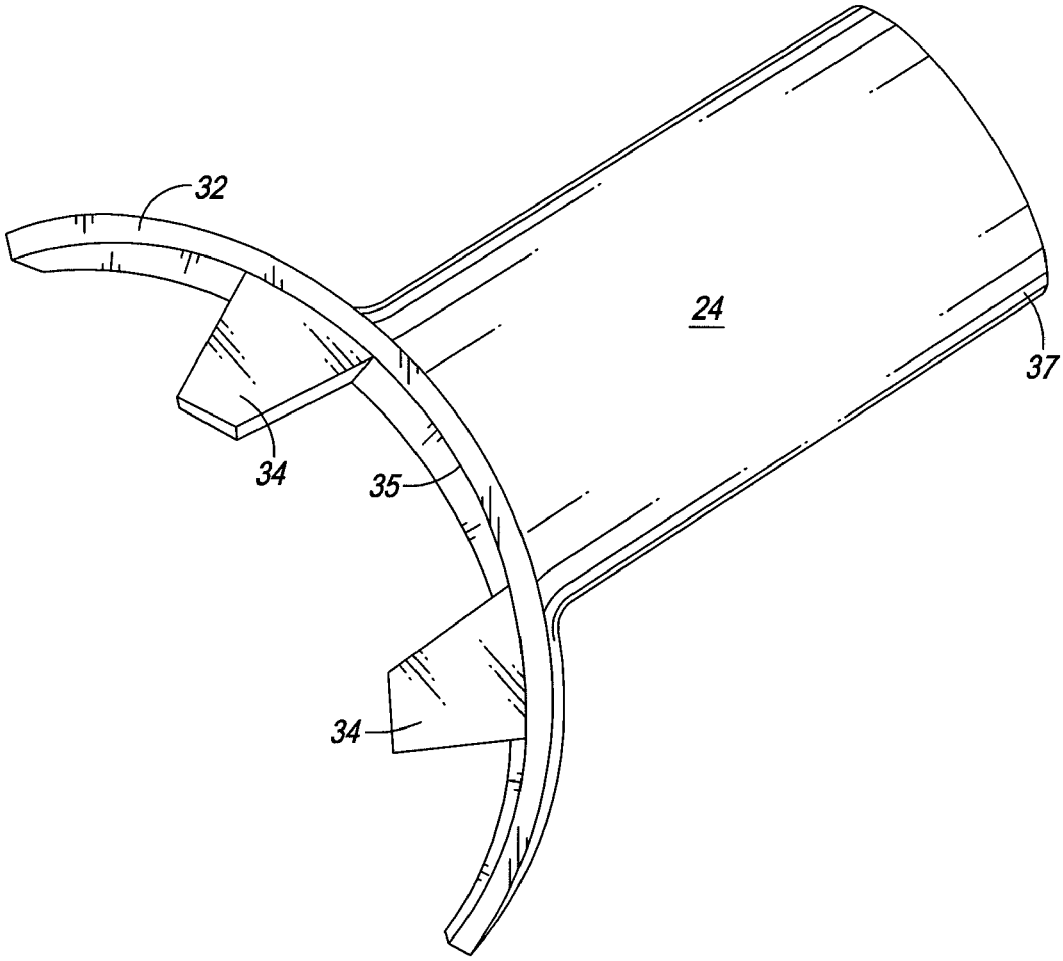
FIG. 3 is a side plan view of the patent module mouthpiece.
Figure 4:
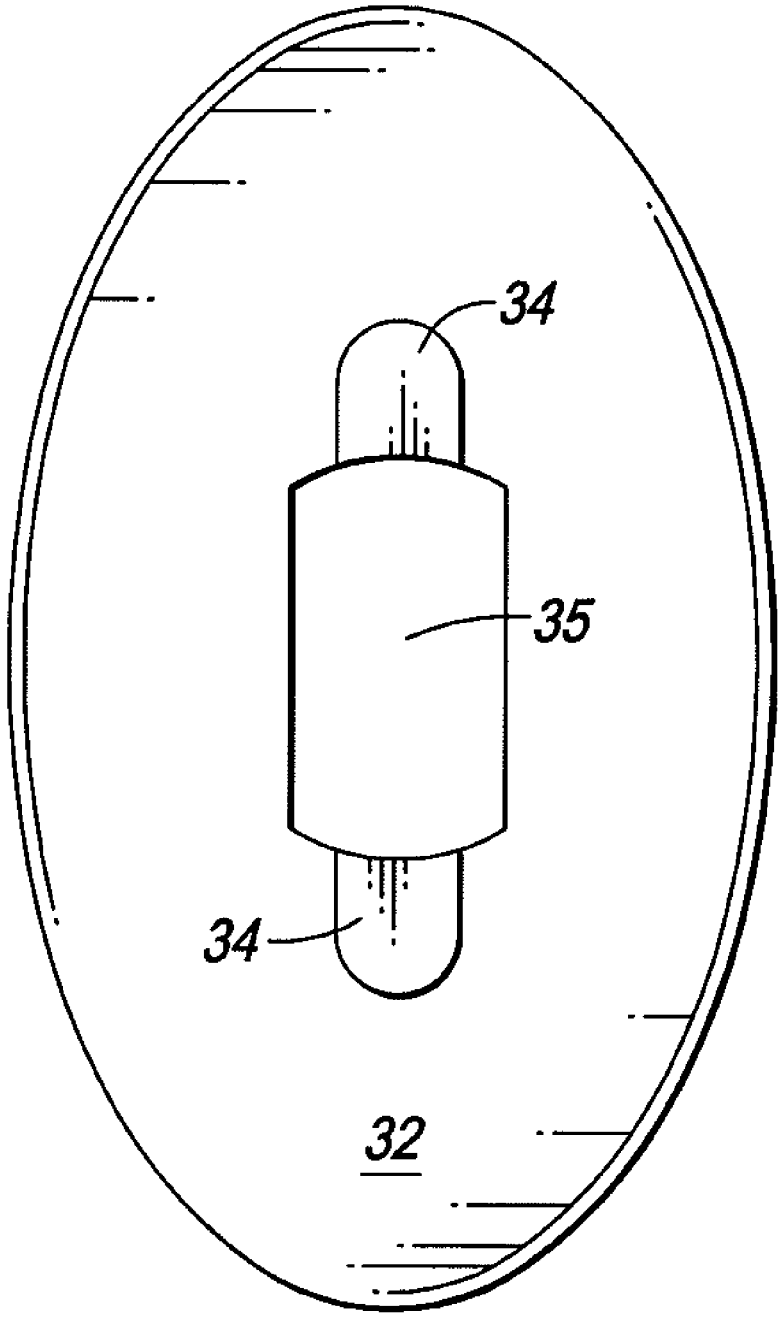
FIG. 4 is a top plan view of the mouthpiece of FIG. 3.

Turning to FIGS. 3 and 4, the patient breathes through the mouthpiece 24 to perform the evaluating and/or exercising. Use of the mouthpiece 24 ensures that all of the air inhaled by the patient is measured and that the pressure is accurately measured. The mouthpiece 24 is optionally provided in an assortment of sizes and shapes for the comfort and ease of use of various patients. The mouthpiece 24 is the portion of the patient module 12 that fits into the patient's mouth to hold the patient module 12 firmly and to provide a seal between the patient's mouth and the patient module 12. As the exercises are done, the patient inhales while the airflow is restricted, creating a suction between the patient module 12 and the electronic module 14. The negative pressure or suction is measured by the electronic module 14 to determine the strength of the inspiratory muscles. Air flows from a small hole in the Y-piece 28 of the patient module 12, through the Y-piece 28 and mouthpiece 24 to the patient. Maintenance of the suction for a period of time exercises the inspiratory muscles as the patient tries to inhale. The mouthpiece 24 is attached to the Y-piece 28 at a first connector 30. It is contemplated that the size of the first connector 30 is variable to accommodate different mouthpieces 24.

In some embodiments the mouthpiece 24 is made of silicone or any other material that prevents injury to the patient or his/her teeth. At one end of the mouthpiece 24 is a guard 32 which the patient covers with his mouth. The guard 32 fits inside the mouth forming a seal with the lips. It also assures that the patient's mouth stays open for the duration of the exercise. Two or more grips 34 are positioned on the patient side of the guard 32 so that, when the guard 32 is in the patient's mouth, the grips 34 are available for the patient on which to bite. A cavity 35 extends through the length of the mouthpiece 24 from the guard 32 to the Y-piece 28, allowing the patient's breath to flow to the y-piece 28. On an end 37 opposing the guard 32 and grips 34, the mouthpiece 24 is friction fit over the first connector 30 of the Y-piece 28.

Figure 5:
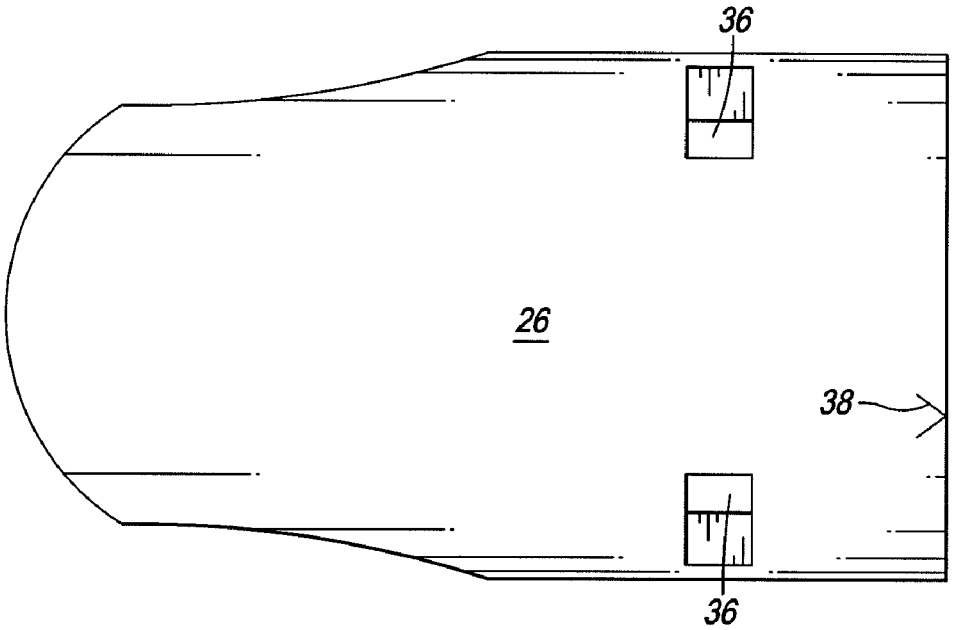
FIG. 5 is a top plan view of the selector.

Two functions are served by the selector 26, shown in FIG. 5. Rotation of the selector 26 allows the patient to choose an appropriate aperture 36 for incoming air depending on whether the strengthening exercises or the endurance exercises are to be done. A pointer icon 38 on the selector is aligned with a selection icon 39 (FIG. 2) on the Y-piece 28 to select the appropriate aperture 36. In some embodiments of the invention, a dumbbell icon is used as the selection icon 39 to denote the position of the selector for the strengthening exercises, while a balloon icon is the selection icon 39 to indicate that the endurance exercises have been selected. Those skilled in the art will readily identify additional icons or other methods of selecting the appropriate exercises that are equally suitable.

If strengthening exercises are selected, the aperture 36 on the Y-piece 28 is substantially closed. A very small amount of incoming air enters an interior of the Y-piece 28 through a small hole 40 in the Y-piece 28 under the selector 26. In at least one preferred embodiment, the hole 40 is about 1 mm in diameter.

Further rotation of the selector 26 allows choice of the size of the aperture 36 to be used for the endurance exercises. A plurality of sizes of the aperture 36 are preferably available to properly exercise the inspiratory muscles, regardless of the initial strength of the muscles or size of the patient. In at least one embodiment, three sizes of the aperture 36 are provided, simply designated "A", "B" and "C". The selection of the aperture 30 to be used by a particular patient is preferably made by the patient's physician or health care provider.

Figure 6:
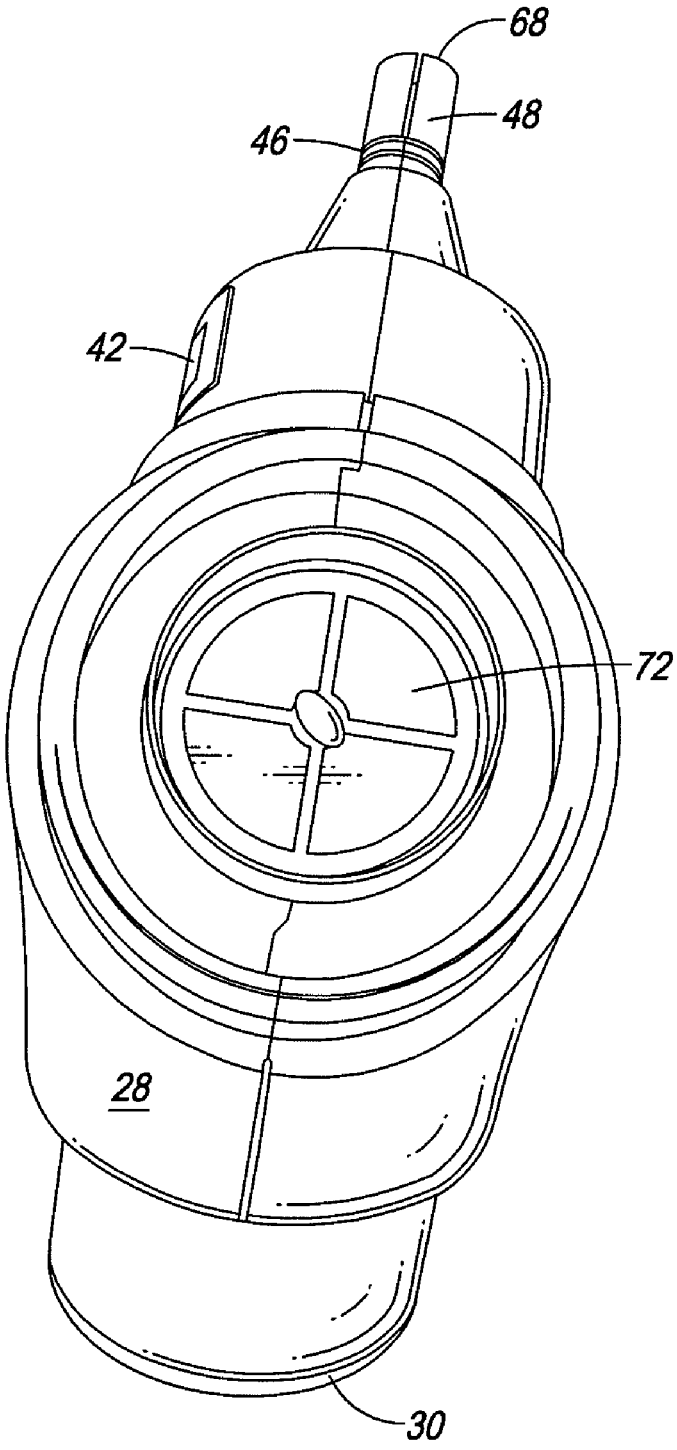
FIG. 6 is a bottom plan view of the Y-piece.

Referring to FIGS. 2 and 6, there is an opening 42 on the Y-piece 28 that aligns with the aperture 36 on the selector 26. When the selector 26 is oriented to perform the endurance exercises, the aperture 36 and the opening 42 align, allowing air to flow freely through the passage 44 created thereby. However, when the strength exercises are selected, the aperture 36 and the opening 42 are askew, hindering air flow since no direct passage is created.

A fitting 46 on an end 48 of the Y-piece 28 protrudes through the selector 26 to allow air flow through the Y-piece 28 to the electronic module 14. In some embodiments, the end 48 and the fitting 46 are substantially circular. This allows the selector 26 to rotate about the Y-piece 28 for selection of the aperture 36 size or selection between the strength exercises and the endurance exercises. The fitting 46 protrudes through the Y-piece 28 sufficiently to be secured to a first fitting 50 (FIG. 1) of a length of hollow tubing 52. A second fitting 54 of the hollow tubing 52 connects to the electronic module 14.

Figure 9:
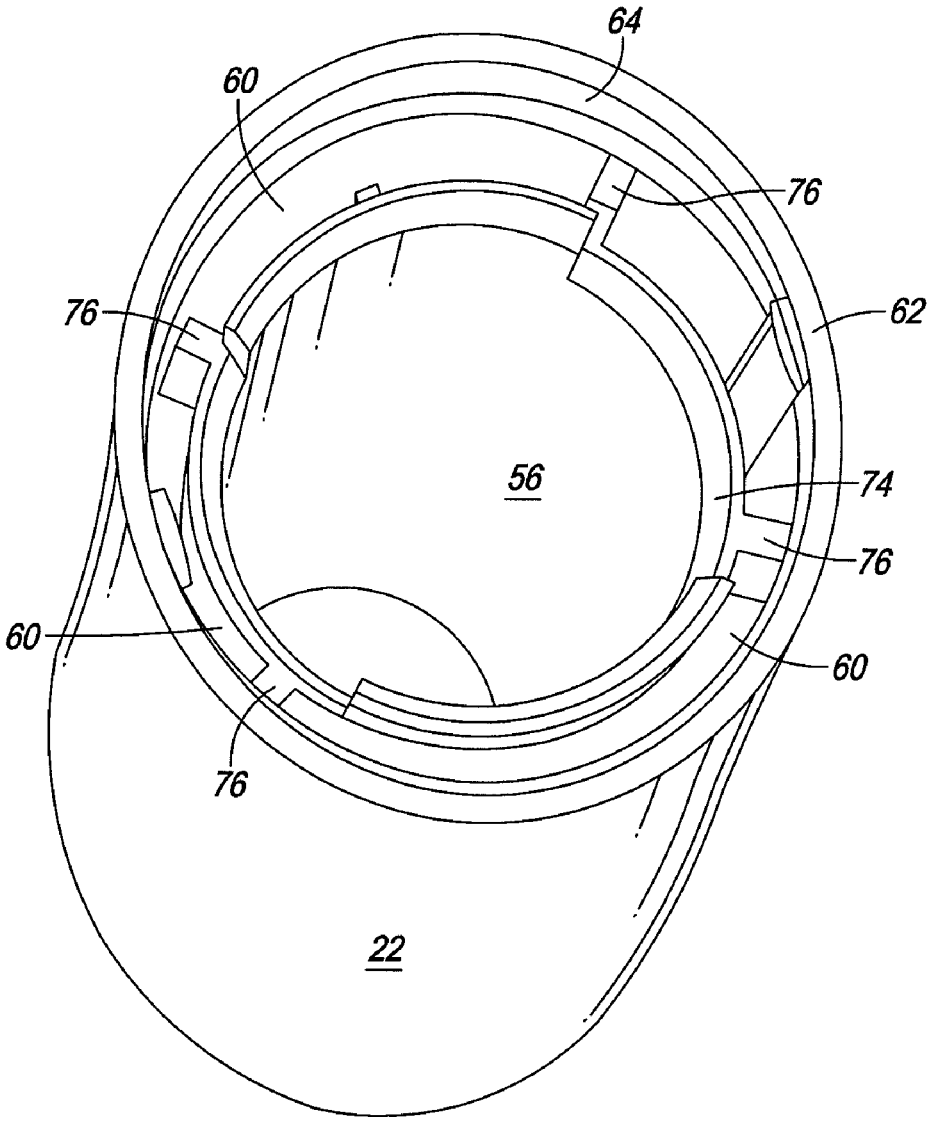
FIG. 9 is a top perspective view of the handle.
Figure 10:
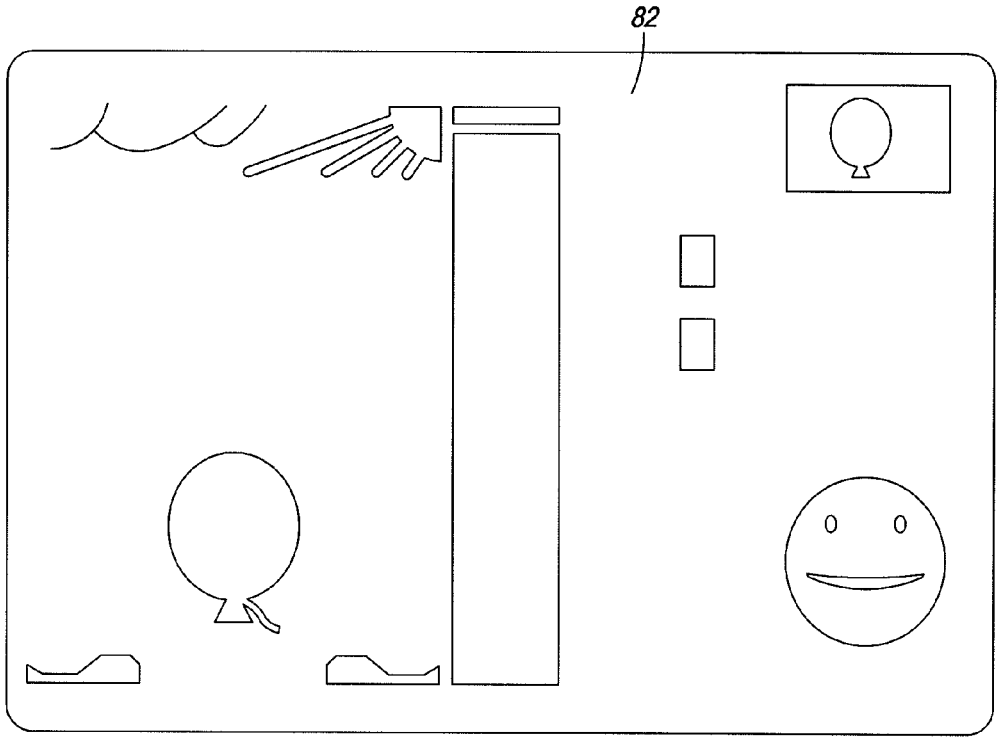
FIG. 10 is an example of feedback displayed to the patient.

The handle 22 is made of any material may be used that is strong enough to support the weight of the patient module 12 and the pressure exerted by the patient's hand. One embodiment of the handle 22 is made with plastic for a low cost option. The patient holds the patient module 12 by wrapping his hand around an exterior 56 of the handle 22. As shown in FIG. 9, the handle 22 is open to the environment. Within the handle 22, a saliva cup 56 retains saliva (not shown) that is present in the exhaled breath. As the expired air enters the saliva cup 56, it changes direction to exit the saliva cup 56. This change in direction encourages deposition of the saliva in the saliva cup 56 as the momentum of the liquid droplets carries them deeper into the saliva cup 56 than the air. The handle 22 is also mounted to the Y-piece 28 so that the patient can comfortably hold the patient module 12 while using it. Vents 60 between the saliva cup 56 and an exterior 60 of the handle 22 permit passage of the exhaled breath through the handle 22 to the environment. An end 62 of the handle 22 opposing the open end includes a third connector 64 to engage and frictionally fit to the Y-piece 28 of the invention 10.

Referring to FIGS. 6 and 9, the handle 22 is also friction fit to the Y-piece 28 of the patient module 12. Where the handle 22 and the Y-piece 28 fit together, there must be sufficient space to allow operation of a second valve 72 and a path for the expired air to exit to the environment. In some embodiments, the handle 22 is substantially hollow. Preferably the saliva cup 56 is attached to the hollow handle 22, in alignment with air flow through a second valve 72. In some embodiments, a top 74 of the saliva cup 56 is attached by several pins 76, allowing air flow entering the saliva cup 56 from the second valve 72 to exit through the hollow handle 22.

Figure 7:
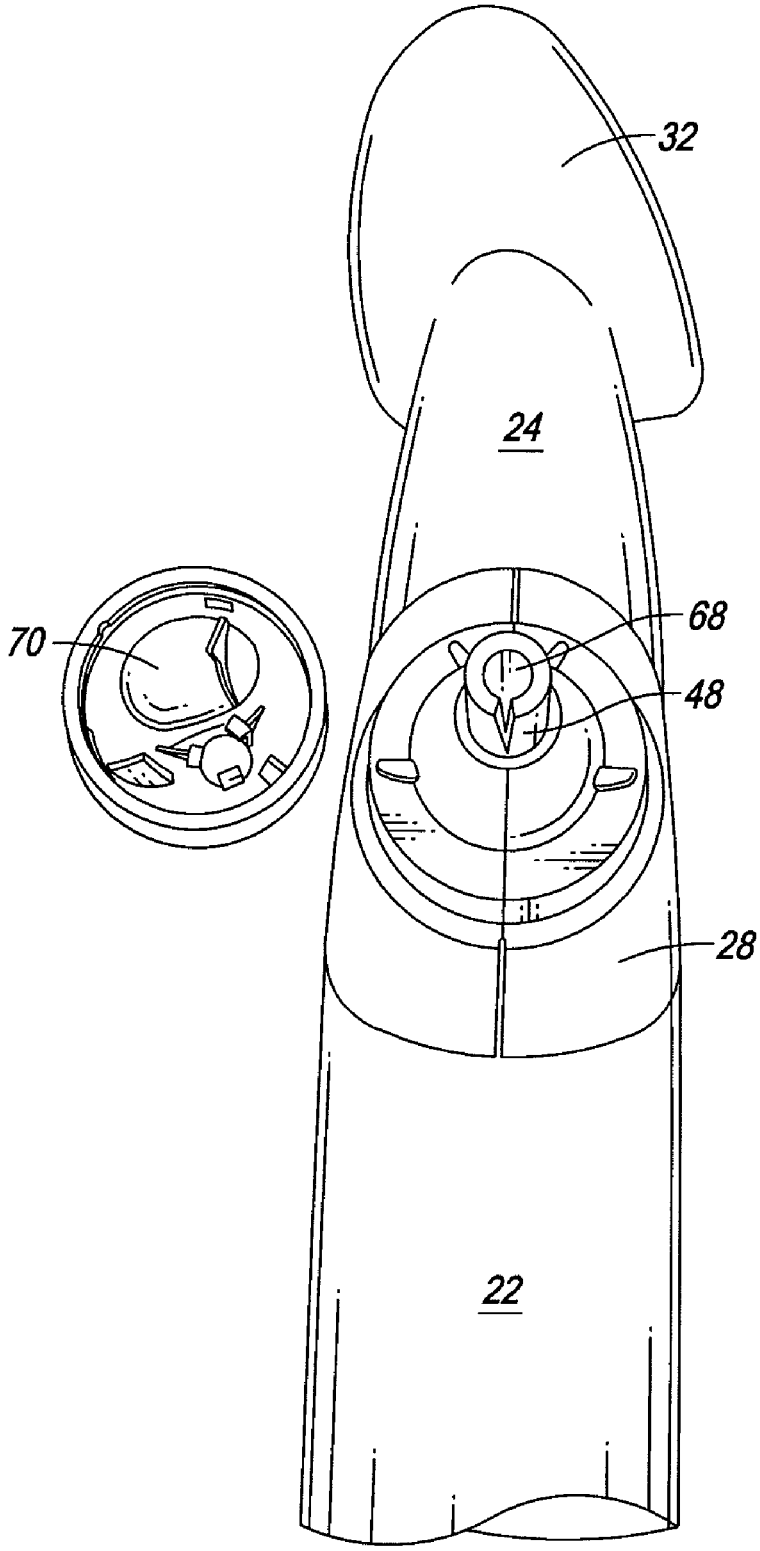
FIG. 7 is a rear perspective view of the Y-piece.
Figure 8:
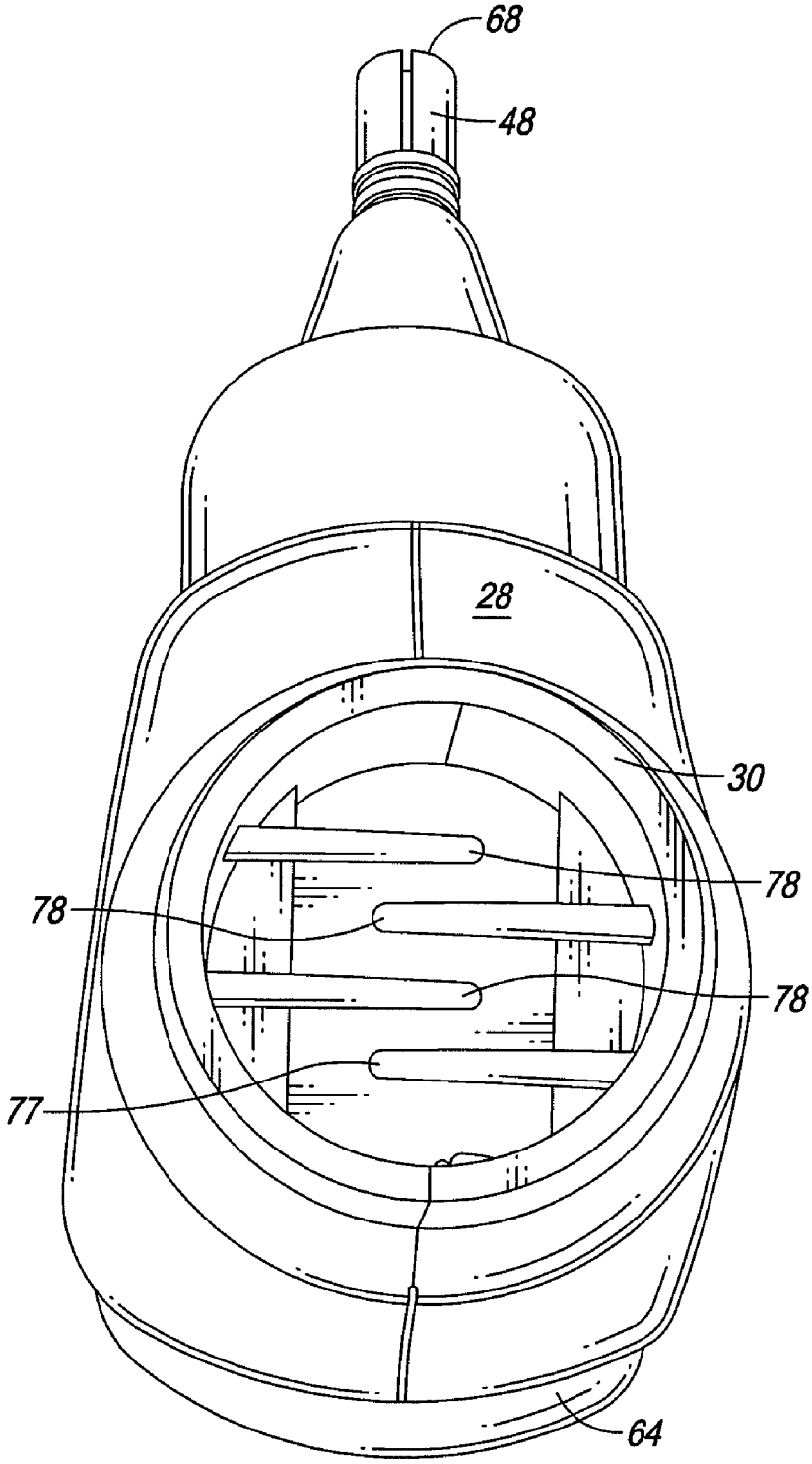
FIG. 8 is a right plan view of the Y-piece.

Looking to FIGS. 6 and 7, shown within the Y-piece 28 are the first valve 70 and the second valve 72 to control the flow of air through the patient device during the exercises. Between the aperture 36 and the mouthpiece 24, the first valve 70 allows air flow toward the mouthpiece 24 only. The second valve 72 is positioned between the mouthpiece 24 and the handle 22, allowing air to flow only away from the mouthpiece 24. The hole 40 (FIG. 2) is positioned between the first valve 70 and the fitting 46 for inflow of air during the strength exercises. Thus, during the inspiration phase of the strength exercises, air is inlet into the Y-piece 28 through the pinhole 40, passing through the first valve 70 to the mouthpiece 24.

Similarly, during the inspiration phase of the endurance exercises, air flows in the passageway 44, through first valve 70 and the mouthpiece 24 and into the patient's lungs. During expiration, air flows from the mouthpiece 24, through the Y-piece 28 and second valve 72, exiting the patient device 12 through the handle 22. Preferably, both the first valve 70 and the second valve 72 are located in the Y-piece 28. Any type of valve is suitable for use that limits air flow to a single direction. In some embodiments, flapper valves are used, such as silicone membranes. The membranes are preferably stamped from a silicone foil.

Referring now to FIGS. 1 and 2, the Y-piece 28 connects these three elements, the mouthpiece 24, the selector 26 and the handle 22 of the patient module 12. In some embodiments, the Y-piece 28 is Y-shaped and has a connector 30, 48, 64 at each vertex. Generally, the connectors 30, 48, 64 are circular to form a seal that is resistant to leakage of air, however, the shape of the connectors 30, 48, 64 is unimportant as long as they are configured to receive the appropriate element. It is envisioned that the shape or size of each of the connectors 30, 48, 64 be slightly different for each of the elements to facilitate replacing each of the elements on the appropriate connector 20, 64, 48. At the handle connector 64, the second valve 72 is a movable membrane that is present on the interior of the third connector 64, acting like a check valve to permit one way flow of air. During the endurance training, air is inhaled through aperture 36 and opening 42 in the patent module 12. While expiring through the patient device, air travels trough the mouthpiece 24, and through the Y-piece 28. The air meets a resistance as the valve 70 closes. Pressure in the Y-piece 28 pushes the second valve 72 aside so that the air escapes through the handle 22.

On the interior of the first connector 30 is a grill 77 to prevent items from the patient's mouth from entering the Y-piece 28 of the patient module 12 or the electronic unit 14. Any pattern of grill 77 could be used that stops motion of large items through the module 12. Examples of large items that may be present in the patient's mouth include food and chewing gum. Some embodiments of the grill 74 include multiple baffles 78 that allow air flow but stop large, solid items. Preferably, the baffles 78 are spaced at about 1 to about 4 mm intervals. Other arrangements of the grill 77 are useful as will be obvious to one skilled in the art.

Figure 11:
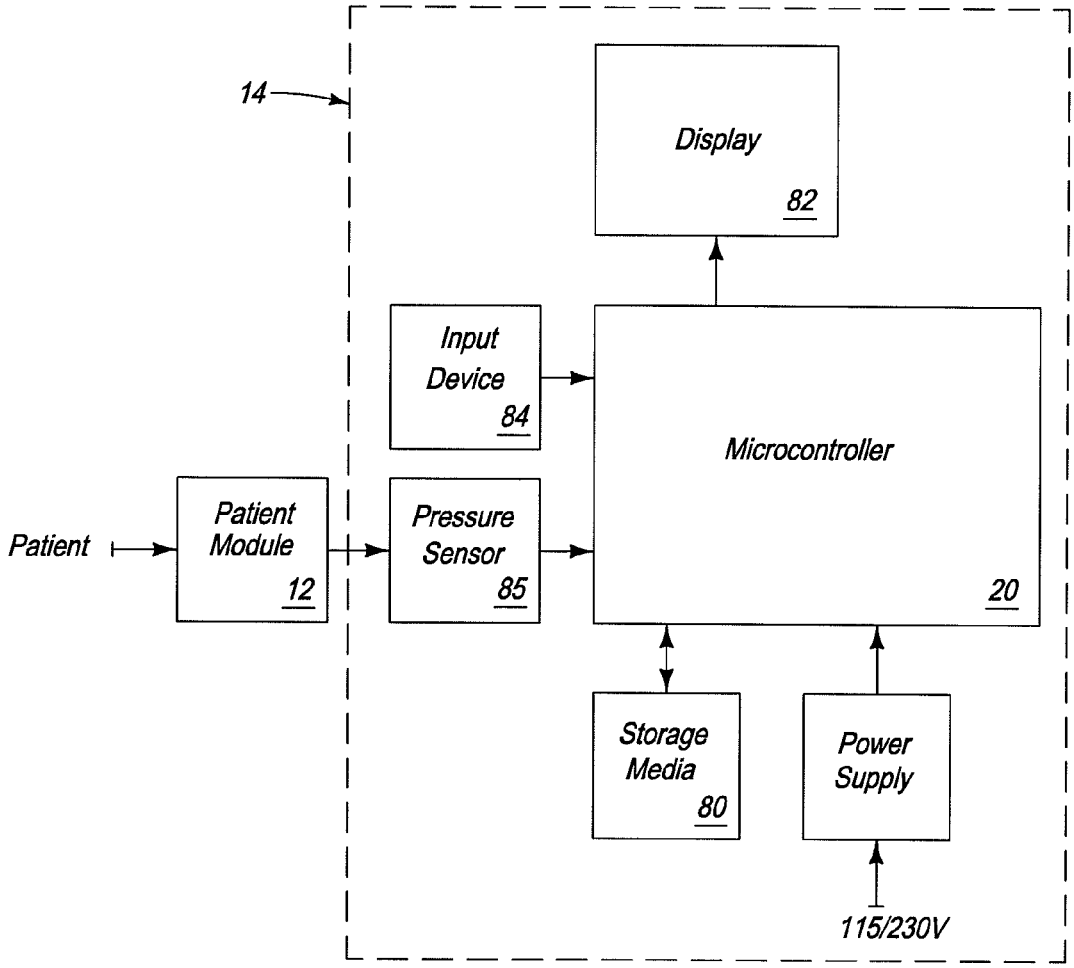
FIG. 11 is a schematic diagram of the electronic module.
Figure 12:
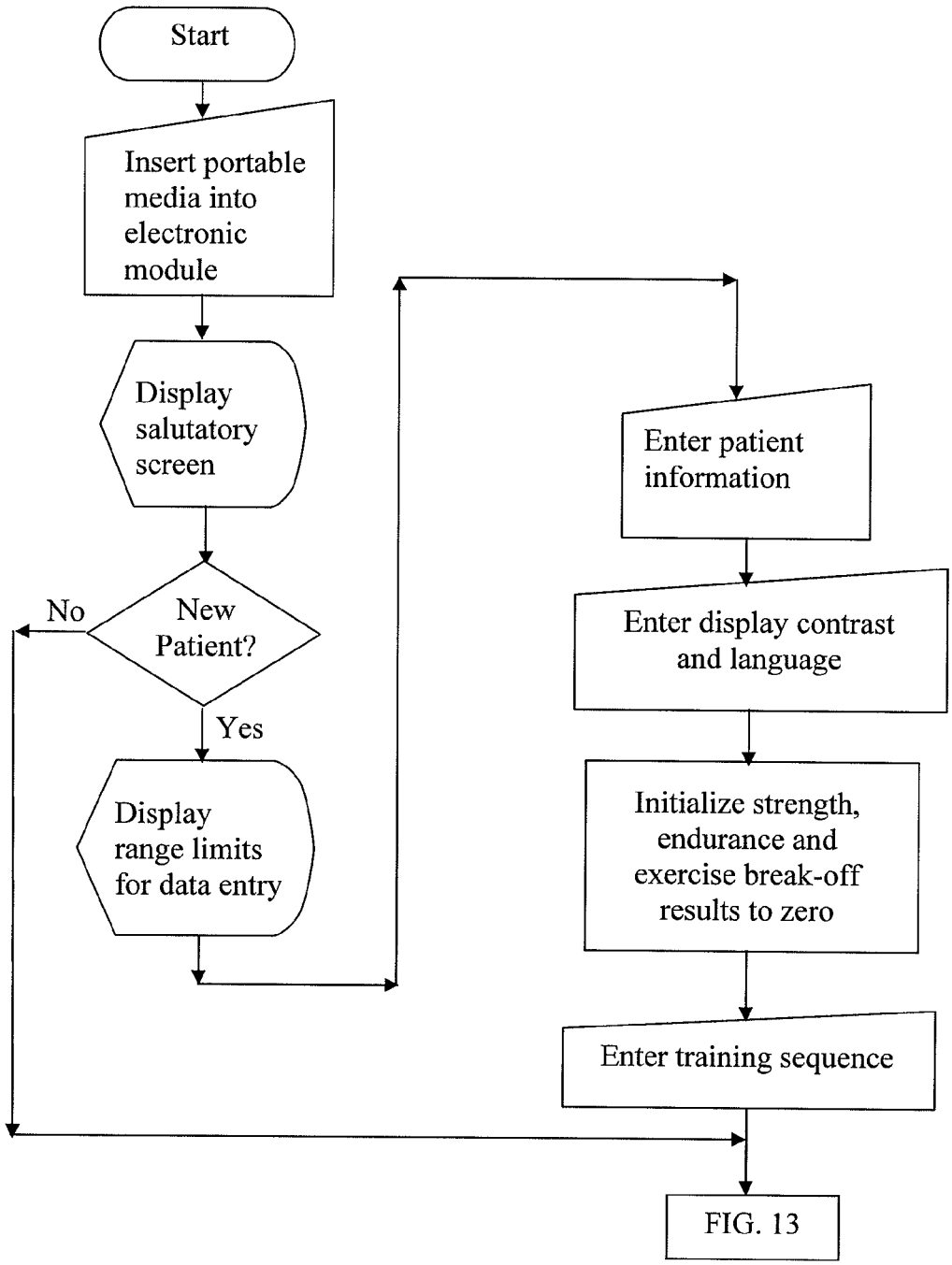
FIG. 12 is a flow chart of the software loaded into the electronic module.
Figure 13:
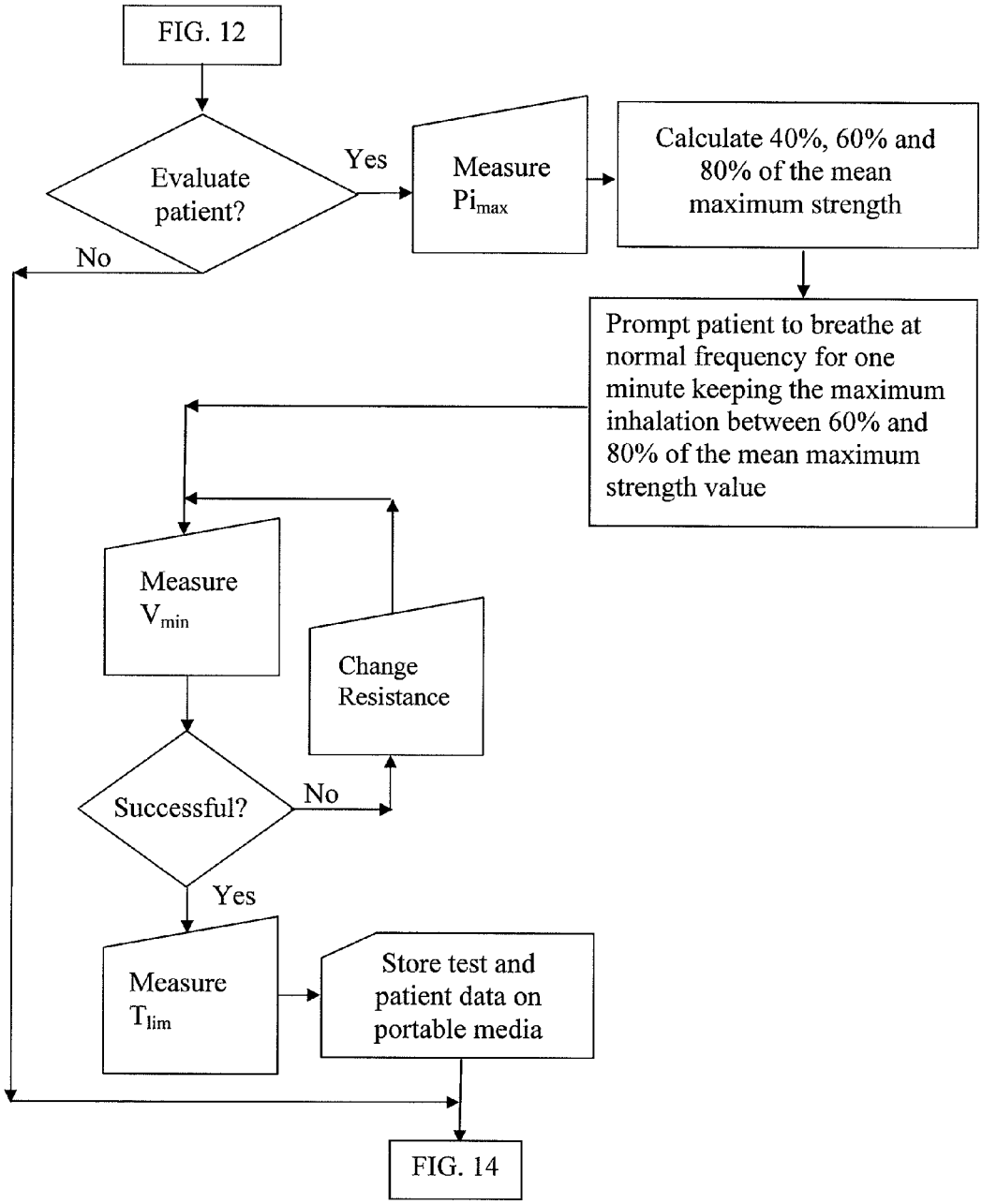
FIG. 13 is a continuation of the flowchart of FIG. 12.
Figure 14:
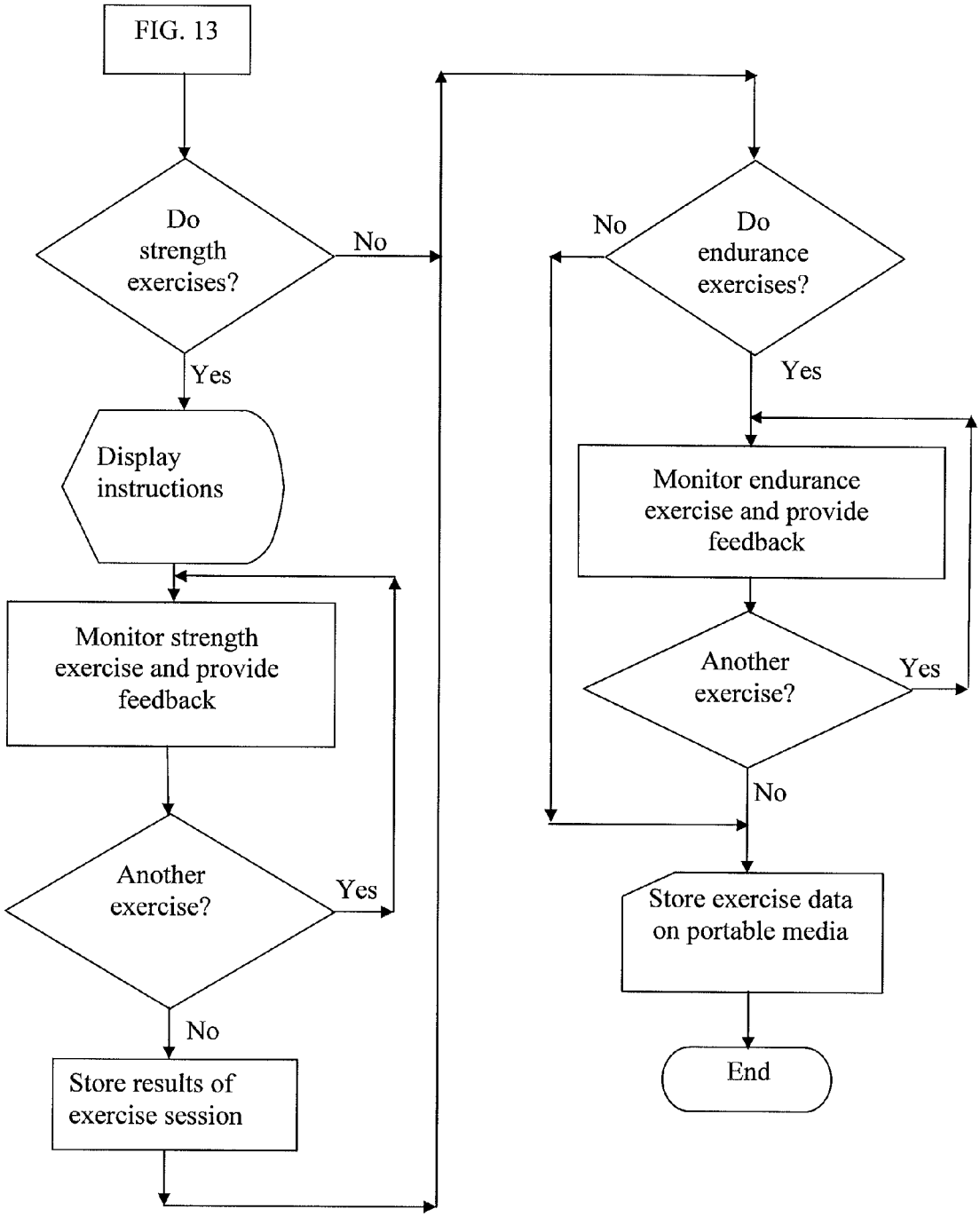
FIG. 14 is the conclusion of the flow chart of FIG. 12 and FIG. 13.

Referring to FIG. 11, in most embodiments, the electronic device 12 is a basic computer that runs a software program 16 designed to direct a patient as to how to set up and use the patient device 12. It includes a micro processor 20 capable of fundamental arithmetic functions and does simple calculations. Sufficient memory is present to store a basic operating system and run at least one program for patient training.

The electronic device 14 has multiple user interfaces. It is in fluid communication with the patient module 12 to obtain pressure data from the mouthpiece 24 during exercises. There is also a means for communicating with a storage media 80 to store and transfer data from the exercise sessions for use by the doctor or therapist. Finally, there is a display 82 that provides instructions and feedback to the patient before, during and after each exercise session. Although visual display is useful, it is not the only means of displaying patient information. It is contemplated that units could be modified to provide audio information or use a tactile approach for use with patients having poor eyesight. These components can be physically combined into any number of pieces as long as the pieces communicate together to properly train the patient. In at least one embodiment of the training device 10, the display 82, storage media 80 interface and the second fitting 54 (FIG. 2) to the patient module 12 are all contained in a single module 12 unit.

Some data is provided to the electronic module 14 by an input device 84. The patient's name can be entered by a wide range of methods, including typing of a name on a keypad, selecting a sequence of letters from those present on a display, inputting a patient identification number by typing the numbers or by selecting the numbers in sequence using a pointing device, selecting the patient from a patient list and the like. In some embodiments, the input device 84 is a plurality of keys but less than a full keyboard. A preferred embodiment uses four keys 84, which are used to scroll through the alphabet, numbers or lists to select appropriate values. Voice recognition software or an input tablet can be used to input data, however, these devices require larger amounts of memory to be available to the microprocessor 20. Where the training device 10 is more limited in the input devices 84 or display 82 space available to it, pictograms or icons may be used to select among a number of choices.

The storage media 80 stores data from the settings and the exercise sessions for review by the patient's health care provider. Examples of suitable storage media 80 include a memory card, diskette, memory stick, portable hard drive, or any other portable storage media. Use of the portable media 80 allows the patient to carry only the media to a visit to his/her health care provider, not the entire training device 10.

Storage of all settings and exercise data for each use is programmed into the software 16.

It is contemplated that the physical location of particular features of the invention be positioned differently than the embodiments described here. In some embodiments, devices for interfacing with the electronic device 14 are contemplated for use in the Y-piece 28. Instruments for measuring air flow and air pressure are optionally positioned within the Y-piece 28, but placement of measuring devices in the handle 22 or the mouthpiece 24 is contemplated.

The first step of the present method is evaluation of the strength and endurance of the patient's inspiratory muscles. Three independent exercises are done to complete the evaluation. First, the maximum inspiratory pressure, $Pi_{max}$, is determined. Next, a minute volume rate, Vmin is determined while the patient breathes near the maximum inspiratory pressure. Finally, a time is determined until the onset of exhaustion. This final value gives a measurement of the endurance of the patient's inspiratory muscles.

The maximum inspiratory pressure, referred to as $Pi_{max}$, is used as to quantify inspiratory muscle strength. It is measured at the mouth during maximal forced inspiration against an almost completely sealed resistance. Room air is breathed through the mouthpiece 24, which is in fluid communication with a pressure sensor 85. A hole of about 1 mm internal diameter prevents glottic closure and the use of buccal muscles during the $Pi_{max}$ maneuvers. The nostrils are preferably occluded by a clip (not shown). $Pi_{max}$ values are determined in a sitting position from residual volume following maximal active and slow expiration. The maximal forced inspiration maneuver is optionally performed from the residual volume of the intrathoracic gas.

To determine the maximum strength, the patient has to inhale short and maximal against a resistance. As the patient inhales during a strength exercise, air present in the patient module 12 is taken into the patient's lungs. Air inside the hollow tubing 52 shifts slightly but is not inhaled by the patient. A small amount of air is drawn through the hole 40. The decrease in air pressure in the Y-piece 28 and hollow tube 52 at the electronic module 14 is measured by the pressure sensor 85. The maximum negative pressure is determined. Several measurements are performed, in some embodiments from about 5 to about 10 measurements are taken. Of all the measurements taken, the highest three are selected and a mean value of $Pi_{max}$ is calculated. Additionally, $P_{80}$ is 80% of the mean $Pi_{max}$ $P_{60}$ is calculated to be 60% of the mean $Pi_{max}$ and $P_{40}$ is 40% of the mean $Pi_{max}$.

During the second and third evaluation exercises, the patient must achieve an inspiratory pressure between $P_{60}$ and $P_{80}$ while breathing at a normal rate. Selection of values based on $Pi_{max}$ relates the difficulty of the endurance exercises to the current condition of the patient.

Endurance of the inspiratory muscle is determined using the same equipment described above. Breathing at a normal frequency, the patient breathes for one minute under the resistance determined by selection of the aperture 56. For evaluation purposes, aperture C should be chosen for patients whose inspiratory muscles are weak. Aperture B is chosen for relatively normal muscle function and aperture A is suitable for athletes or others having strong inspiratory muscles.

Three lines on the display show 40%, 60% and 80% of the average maximum pressure determined in the strength exercises. The patient is now prompted to breathe at a normal frequency for one minute, keeping the maximum inhalation between the 60% and 80% lines. A clock continuously monitors the time passed since beginning of the measurement, counting down the time left until the measurement is over. The electronic module 14 monitors the inspiratory pressure.

The conversion from pressure to flow is determined from a pressure verses flow chart developed for each of the apertures 36. Each flow chart has been converted into a lookup table for use by the software 16. Thus, the software 16 converts the inspiratory pressure monitored by the electronic module 14 into volume flow rates. The volume flow rate is evaluated every 6 milliseconds and is integrated by an electronic integrator to obtain the air volume over the one minute test.

If the patient does not achieve the 60% goal, then the resistance can be adjusted to allow attainment of the goal. The resistance is adjusted by changing the aperture 36 from aperture A to aperture B or from aperture B to aperture C. Moving to a smaller aperture 36 makes it easier to achieve $P_{60}$.

A second phase of the endurance evaluation is a measurement of the time until the onset of exhaustion, $T_{lim}$. The same exercise is done as above, but instead of continuing for one minute, the duration is set to infinity. The patient continues breathing through the mouthpiece 24 until he/she fails to reach $P_{60}$ for four consecutive breaths. At this point the muscles are considered to be exhausted. $T_{lim}$ is then measured from the time the exercise began until the beginning of the first of the four breaths where $P_{60}$ was not achieved.

Following the initial evaluation, parameters are entered into the software 16 for use during regular training sessions. It is understood that not all of the settings are necessarily entered between the evaluation and the training. A number of the settings are preferably completed prior to the evaluation. For example, the language to be used us selectable prior to the evaluation so that the instructions are understood. However, the values for $Pi_{max}$, $P_{80}$, $P_{60}$, $P_{40}$, the minute volume rate and $T_{lim}$ will not be set until after the evaluation process.

Prior to beginning training, it is first preferable to provide power to the training device 10. It displays a salutatory screen with a logo to provide optical verification that the display 82 is powered and is running the appropriate software 16. In some embodiments, the contrast of the display 82 is selectable, and is set prior to the evaluation tests so that the results are easily read.

The patient name is identified to the training device 10 for recordkeeping purposes. Any method can be used to identify the patient, as described above. If the patient is a new patient, the device optionally calls a subprogram to request additional data on a new patient such as would be useful for recordkeeping, such as, but not limited to the patient's contact information, diagnosis and/or doctor's name.

The number of exercises per exercise session, the number of permissible failures per exercise session, the rest time between exercises, the volume rate and the patient identification settings are set prior to use of the device for training inspiratory muscles. A health care provider determines the patient-specific settings.

Following entry of patient data, the software prompts the patient to reset to zero the values strength, endurance and exercise break-off results. Where values are accumulated, they are reset at the start of each new set of evaluation tests or exercise session to ensure that accurate counts, averages, minimum and maximum values are used in calculations described below.

In some embodiments of the software 16, texts and/or pictograms are displayed showing a range of acceptable values for data for the limits of parameters to be input to the process prior to use. Examples of ranges for muscle strength testing include minimum pressure from 2-200 mbar, number of exercises 1-20, number of permissible failures 1-20; pause time between successive exercises 1-3 seconds and combinations thereof. For muscle endurance, the display shows the range of volume 1-301, the number of exercises 1-20, the number of permissible failures 1-100, and the pause time between successive exercises of 1-20 seconds or combinations thereof. This step informs and/or reminds the user of the acceptable values to be input when queried.

Next the electronic module 14 prompts the user to select a particular training sequence. The user selects and enters the selection into the training device 10. At minimum, the device 10 has a training regimen for endurance training of the inspiratory muscles. Strength training is also optionally available, although scientific evidence strongly supports training for both strength and endurance. Depending on the needs of the particular patient, one or the other training regimen, or both, are selectable. Other training programs may also be available for use with the same training device. Once a selection has been made, it is entered through the input device 84. Values of $Pi_{max}$, $P_{80}$, $P_{60}$, $P_{40}$, the minute volume rate and $T_{lim}$ are obtained from the evaluation tests. Many of these values are stored for use in subsequent training sessions, depending on the training sequence selected. By way of example, the default values for one preferred embodiment are as follows:

| | |
|---|---|
| Minimum Strength Value in mbar; | 50 |
| Number of Strength Exercises | 5 |
| Permissible Fails Strength | 3 |
| Pause Time for Strength Exercise, sec | 5 |
| Minute-Volume in 1/min | 8 |
| Number of Endurance Exercises | 5 |
| Permissible Fails Endurance | 3 |
| Pause Time for Endurance Exercises, sec | 5 |
| Display Contrast Value | 185 |
| Patient Module Selector Setting (A = 1, B = 2, C = 3) | 3 |
| Training Sequence (1 = S + E, 2 = S, 3 = E) | 1 |
| Card Number | 1 |
| Language Code (English) | 32 |
| Number of Measurements for $Pi_{max}$ determination | 10 |

After the settings are selected and entered, the settings are copied onto the data storage media 80. When evaluation or training data is reviewed by the health care provider, all settings will be known to him/her so that the results can be evaluated in proper context.

These preliminary steps are useful in preparing the training device 10 module for the exercises. When the patient enters the instruction screen to perform the strength exercises, a welcome screen is displayed, confirming to the user that the appropriate screen has been selected. The number of exercises, the number of permissible fails, and $Pi_{max}$ are displayed.

An important aspect of this invention is providing feedback to the patient as to the progress of their training. Data are displayed in real time. For strength exercises, feedback shows the number of exercises, then number of allowed failures and the minimum pressure that has to be achieved. During breathing, actual pressure is shown on a graph. Feedback for endurance exercises shows a time bar of 1 minute and a symbol following an inspiration and expiration graph.

The strength exercises are performed in a similar way as the evaluation exercise to determine $Pi_{max}$. With the selector 26 set to do strength exercises, the patient inhales against a resistance. The pressure developed during the inspiratory exercise is shown graphically on the display 92 of the training device 10 and the resulting peak pressure is displayed numerically in appropriate units, such as mbar or cm $H_2O$. The exercise is successful if the achieved training pressure exceeds $Pi_{80}$.

Understanding that a patient may cough or need to catch his breath during the exercises, the software 16 is optionally set to allow the patient multiple tries to do a single exercise. In a preferred embodiment, three attempts are permitted to reach $Pi_{80}$ before the exercise is considered a failure. The software 16 continues to prompt the patient to do strength exercises until either the maximum number of failures has been reached in the session, or the number of successful exercises has been completed. At the conclusion of the exercise session, feedback is given to the patient as to the success or failure of the exercise session, for example, with a smiley face or a frowny face.

If the training regimen includes endurance exercises, an instruction screen is displayed either instead of the strength training prompts or following the completion of the strength training exercises. The number of exercises, the number of permissible fails and a one minute timer are included on the display. While each of the endurance exercises is done, the inspiratory pressure is monitored and the one minute timer counts down to show the patient exactly how much longer the exercise will last.

During the endurance exercise session, the display 82 shows a balloon rising and falling. To successfully complete the exercise, the patient is directed to keep the balloon between the floor (the bottom position) and the sky (the top position). The midpoint between the floor and the sky is assigned to minute volume rate, $V_{min}$, obtained during the evaluation step. During expiration, the balloon falls at the rate, $V_{min}$. The sky is $V_{min}$+½ liters/min and the floor is $V_{min}$−½ liters/min. Therefore the difference between the volume rate at the sky and the volume rate at the floor is 1 liter/minute. The balloon rises during inspiration when the inspiratory minute volume surpasses $V_{min}$. During expiration the balloon falls as the inspiratory minute volume is negative. The balloon falls at a rate of $V_{min}$. Before the balloon reaches the floor, the patient should start to inspire again, keeping the balloon in the air and continuing for the one minute.

During the training session, the microprocessor 20 calculates the volume of air flow during the minute. The specific volume rate is calculated using 60% of the maximal recordable inspiratory pressure generated per inspiratory breath while expiration flows through a two-way valve unimpeded. During the endurance test, inspiratory mouth pressure, inspiration time and expiration time are measured for each breath, followed by calculation of the inspiratory flow. For an individual patient, the health care professional can choose to reduce the inspiratory pressure goal that the patient tries to attain. During the set-up phase, if a $P_{40}$ value is selected as the goal, the software 16 can be set to instruct the patient to maintain pressure between $P_{40}$ and $P_{60}$ instead of maintaining a pressure between $P_{80}$ and $P_{60}$.

Although $T_{lim}$ is not necessarily measured at each exercise session, training the inspiratory muscles using the endurance exercises described above will improve the muscle endurance. As the muscles become stronger, exercising at the settings determined in the initial evaluation will eventually no longer challenge the muscles to grow stronger. Therefore, at intervals prescribed by the health care provider, the patient should be reevaluated using the three evaluation exercises described above. A suitable interval for reevaluation for many patients is about 4 to about 6 weeks from the last evaluation. If endurance has improved, it may be desirable to change the setting of the selector 26 from C to B or from B to A. Improvement in endurance also results in new values for $Pi_{60}$ and $Pi_{80}$ in the settings, requiring the muscles to work harder to successfully complete the exercises. Reevaluation, particularly obtaining a new value for $T_{lim}$ will give an accurate measure of improvement in the endurance of the inspiratory muscles.

If strength exercises are also part of the exercise session, the inspiratory muscles will grow stronger as exercising progresses. When strengthening of the muscles occurs, the exercises should be more difficult if it is desirable to continue strengthening the muscles. Reexamination of the patient periodically will determine how much improvement in muscle strength has occurred. Determination and use of a new value of $Pi_{max}$ should challenge the muscles at their current strength level.

While one or more particular embodiments of the inspiratory muscle training device has been shown and described, it will be appreciated by those skilled in the art that changes and modifications may be made thereto without departing from the invention in its broader aspects and as set forth in the following claims.

What is claimed is:

1. A system for training inspiratory muscles of a patient, comprising:

a training device comprising a patient module and an electronic module in fluid communication with each other, said patient module comprising a mouthpiece and said electronic module comprising an electronic processor capable of running software; and software installed on said electronic processor within said electronic module, said software configured to test the endurance of the inspiratory muscles of the patient, including a calculation of a time to the onset of exhaustion of the inspiratory muscles of the patient, set the parameters of the electronic module, direct and monitor endurance training by the patient, provide feedback to the patient and repeat the testing, setting, directing and providing steps periodically;

said onset of exhaustion of the inspiratory muscles being a beginning of a first of four breaths where 60% of a mean maximum inspiratory pressure is not achieved, wherein said mean maximum inspiratory pressure is an average of a plurality of maximum inhalation pressure measurements of the patient, wherein when the patient inspires through said mouthpiece the inspiratory pressure is monitored by said software and wherein said software is used to carry out at least one of said testing, setting, directing, providing steps.

2. The system of claim 1, wherein said software directs the testing of the strength of the inspiratory muscles, the average minute volume rate of inhalation and the endurance of the inspiratory muscles.

3. The system of claim 2 wherein said patient module further comprises a selector, and wherein the strength of the inspiratory muscles is determined by the patient setting a resistance on said selector against which the patient inhales, said software prompting the patient to inhale at maximum pressure for a first time interval and then calculating an average maximum pressure over a number of inhalations.

4. The system of claim 3 wherein the average volume rate for inhalation is determined by the patient breathing into said mouthpiece of said, patient device at a normal rate while keeping the inspiration pressure above a minimum inspiration pressure and wherein said software provides feedback to the patient as to whether the inspiration pressure is above the minimum inspiration pressure.

5. The system of claim 4 wherein the minimum inspiration pressure is from about 40% of the average maximum pressure.

6. The system of claim 2 wherein the endurance of the inspiratory muscles is determined by said software instructing the patient to breathe into said mouthpiece of said patient module at a normal rate while maintaining a minimum volume per minute, and measuring the time from the start of the testing until the onset of exhaustion.

7. The system of claim 6 wherein said patient module further comprises a hollow handle and wherein, when the patient expires into said patient module, the exhaled air exits said patient module through said handle.

8. The system of claim 1 wherein said software further directs at least one of the group consisting of displaying of the time remaining for each exercise, displaying the number of exercises remaining in each exercise session, providing feedback to the patient when the exercise session is completed successfully, displaying an icon representing the minute volume rate as it rises and falls during respiration, and combinations thereof.

9. The system of claim 1 wherein said electronic module further comprises at least one of the group consisting of a display, a power supply, at least one input device, a memory card reader/writer and combinations thereof.

10. The system of claim 1, wherein said fluid communication between said patient module and said electronic module comprises a hollow hose or tube.

* * * * *